US010139756B2

(12) United States Patent
Tanaka

(10) Patent No.: US 10,139,756 B2
(45) Date of Patent: Nov. 27, 2018

(54) IMAGE FORMING APPARATUS

(71) Applicant: CANON KABUSHIKI KAISHA, Tokyo (JP)

(72) Inventor: Shoji Tanaka, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/652,631

(22) Filed: Jul. 18, 2017

(65) Prior Publication Data

US 2018/0024471 A1 Jan. 25, 2018

(30) Foreign Application Priority Data

Jul. 21, 2016 (JP) ..... 2016-143439

(51) Int. Cl.
*G03G 15/10* (2006.01)
*G03G 15/00* (2006.01)

(52) U.S. Cl.
CPC ..... *G03G 15/104* (2013.01); *G03G 15/5016* (2013.01); *G03G 15/553* (2013.01)

(58) Field of Classification Search
CPC ..... G03G 15/104; G03G 15/5016; G03G 15/553; G03G 15/0877; G03G 21/10
See application file for complete search history.

(56) References Cited

U.S. PATENT DOCUMENTS 6,151,469 A * 11/2000 Lee ..... G03G 15/104 399/237
2008/0205935 A1* 8/2008 Oda ..... G03G 15/104 399/250
2011/0206417 A1* 8/2011 Oda ..... G03G 15/104 399/238
2011/0206418 A1* 8/2011 Hobo ..... G03G 15/104 399/238

FOREIGN PATENT DOCUMENTS

JP H09-244419 A 9/1997
JP 2006-251669 A 9/2006
JP 2007-171438 A 7/2007
JP 2009-180807 A 8/2009

* cited by examiner

*Primary Examiner* — Sandra Brase
(74) *Attorney, Agent, or Firm* — Fitzpatrick, Cella, Harper & Scinto

(57) ABSTRACT

An image forming apparatus includes an image bearing member, a developing device developing an electrostatic latent image with a liquid developer containing toner and a liquid carrier, a carrier storing container storing the carrier, and a mixer to mix the toner and the carrier to form the liquid developer to be supplied to the developing device, wherein the liquid developer has a predetermined toner ratio. A first discharging portion on the carrier storing container discharges the carrier toward the mixer, a collecting mechanism collects the carrier from the developing device into the carrier storing container, and a second discharging portion on the carrier storing container discharges the carrier toward a carrier collecting container configured to collect the carrier. The carrier collecting container is detachably mountable to the carrier storing container.

6 Claims, 7 Drawing Sheets

(a)

(b)

IMAGE FORMING APPARATUS

FIELD OF THE INVENTION AND RELATED ART

The present invention relates to an image forming apparatus, using a liquid developer, such as a copying machine, a printer or a facsimile machine.

Conventionally, an image forming apparatus for forming an image by developing a latent image with the liquid developer containing toner and a liquid carrier has been known. The image forming apparatus of this type includes a content adjusting container (tank) for adjusting a toner content of the liquid developer fed to a developing device. With this content adjusting container, a toner tank in which a toner liquid having a higher toner content than a desired toner content of the liquid developer fed to the developing device and containing the toner and the carrier, is stored and a carrier tank in which the carrier is stored are connected. Then, from the toner tank and the carrier tank, the toner liquid and the carrier are supplied, respectively, into the content adjusting container while a supplying amount and a supplying time of each of the toner liquid and the carrier are controlled. As a result, adjustment is carried out so that the toner content and a liquid amount of the liquid developer in the content adjusting container are target values.

Further, in the image forming apparatus of this type, of the liquid developer used for development, the carrier which has not been transferred onto a recording material such as paper is collected and used again. However, in this constitution, there is a problem such that in the case where a job with a high image ratio is continued, an amount of the collected carrier is larger than an amount of the carrier consumed and thus there is a possibility that the carrier overflows the carrier tank.

In order to solve this problem, Japanese Laid-Open Patent Application (JP-A) Hei 9-244419 discloses a constitution in which the carrier overflowing the carrier tank is subjected to removal of residual toner with a filter, and thereafter, is collected in an excessive liquid tank which is another tank and then is fed from this excessive liquid tank into the developing device and the carrier tank.

However, in the conventional constitution, in the case where the job with the high image ratio is continued, the carrier amount is larger than an accommodating amount of the carrier tank and the excessive liquid tank. Therefore, there is a method of increasing these tanks in size, but the method invites upsizing of the apparatus. For that reason, it is desirable that a constitution capable of collecting an excessive carrier by a simple method without extremely increasing the sizes of the tanks is employed.

SUMMARY OF THE INVENTION

A principal object of the present invention is to provide an image forming apparatus capable of accommodating an excessive carrier by a simple constitution.

According to an aspect of the present invention, there is provided an image forming apparatus comprising: an image bearing member; a developing device configured to develop an electrostatic latent image, formed on the image bearing member, with a liquid developer containing toner and a liquid carrier; a carrier storing container configured to store the carrier; a mixer configured to mix the toner and the carrier to form the liquid developer to be supplied to the developing device, wherein the liquid developer has a predetermined toner ratio; a first discharging portion provided on the carrier storing container and configured to discharge the carrier toward the mixer; a collecting mechanism configured to collect the carrier from the developing device into the carrier storing container; and a second discharging portion provided on the carrier storing container and configured to discharge the carrier toward a carrier collecting container configured to collect the carrier, wherein the carrier collecting container is detachably mountable to the carrier storing container.

Further features of the present invention will become apparent from the following description of exemplary embodiments with reference to the attached drawings.

DESCRIPTION OF EMBODIMENTS

An image forming apparatus according to the present invention will be specifically described with reference to the drawings.

Embodiment 1

1. General Structure and Operation of Image Forming Apparatus

Figure 1:
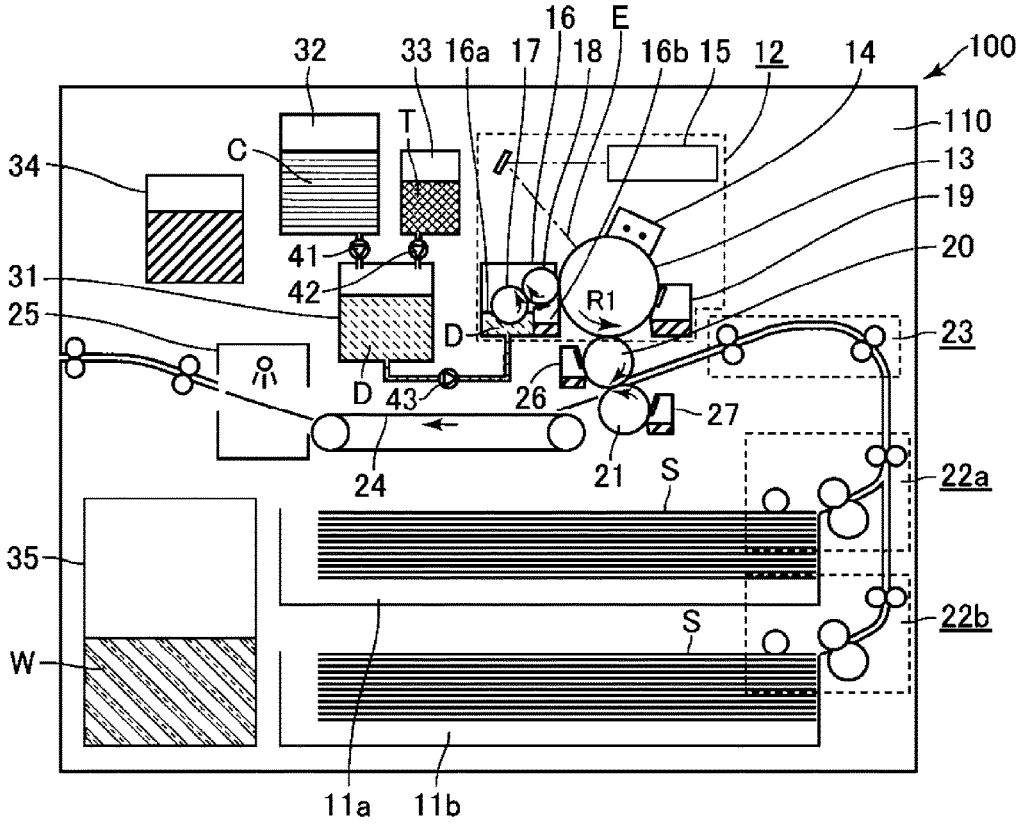
FIG. 1 is a schematic sectional view of an image forming apparatus.

FIG. 1 is a schematic sectional view of an image forming apparatus 100 in this embodiment.

The image forming apparatus 100 in this embodiment is a digital printer of an electrophotographic type in which an image is formed on a recording material (a sheet, a sheet material such as an OHP sheet and so on) S with a liquid developer. The image forming apparatus 100 is operated on the basis of an image signal, and a toner image formed by an image forming portion 12 is transferred onto the recording material S successively fed from each of cassettes 11*a*, 11*b* and then is fixed on the sheet S, so that an image is formed on the recording material S. The image signal is sent from an external terminal such as an unshown scanner (image reading device) or an unshown personal computer.

The image forming portion 12 includes a photosensitive drum 13 as an image bearing member, a charger 14 as a charging means, an exposure device (laser scanner) 15 as an exposure means, a developing device 16 as a developing means and a drum cleaner 19 as a photosensitive member cleaning means.

The photosensitive drum 13 is rotationally driven in an arrow R1 direction (counterclockwise direction) shown in FIG. 1. A surface of the rotating photosensitive drum 13 is charged to a predetermined polarity and a predetermined potential by the charger 14. The surface of the charged photosensitive drum 13 is irradiated with laser light E from the laser exposure device 15 depending on the image signal, so that an electrostatic latent image (electrostatic image) is formed on the photosensitive drum 13. The electrostatic latent image formed on the photosensitive drum 13 is developed (visualized) as a toner image by the developing device 16.

In this embodiment, in the developing device 16, a liquid developer (liquid material) D in which a powdery toner which is a dispersoid is dispersed in a liquid carrier which is a dispersion medium is accommodated, and the developing device 16 develops the electrostatic latent image with the liquid developer D. The liquid developer D is generated by mixing and dispersing toner T in a carrier C in a predetermined ratio in a mixer 31 which is a content adjusting container (tank) having a function of mixing the toner T with the liquid carrier C, and then is fed to the developing device 16. The carrier C is accommodated in a carrier tank 32 which is a carrier storing container (tank). Further, the toner T is stored as a toner liquid in a toner tank 33 which is a toner storing container (tank). The toner liquid contains the carrier C and the toner T having a higher toner content than a desired toner content (a proportion of a weight of the toner to an entire weight of the liquid developer) of the liquid developer D fed to the developing device 16. In this embodiment, also the "toner liquid" is described in some cases by adding a symbol "T" which is the same as that of the toner. Then, depending on a mixed state of the carrier C and the toner T in the mixer 31, the carrier C and the toner T are supplied from the carrier tank 32 and the toner tank 33, respectively. In the mixer 31, a stirring blade (not shown) as a stirring means driven by a motor or the like is provided, and by this stirring blade, the carrier C and the toner T which are supplied in the mixer 31 are mixed by being stirred, so that the toner T is dispersed in the carrier C.

The liquid developer D fed from the mixer 31 to the developing device 16 is coated (supplied) on a developing roller 18 as a developer carrying member for carrying and feeding the liquid developer D by a coating roller 17 as a supplying member. The liquid developer D coated on the developing roller 18 is fed to an opposing portion (developing portion) to the photosensitive drum 13 by rotation of the developing roller 18, and is used for developing the electrostatic latent image. The carrier C and the toner T which remain on the developing roller 18 after passing the developing portion is collected in a collecting section 16*b* of the developing device 16. In this embodiment, each of coating of the liquid developer D from the coating roller 17 onto the developing roller 18 and the supply (development) of the liquid developer D to the electrostatic latent image on the photosensitive drum 13 from the developing roller 18 is made using an electric field. Further, the collection of the toner T and the carrier C into the collecting section 16*b* is carried out by scraping off the toner T and the carrier C from the surface of the rotating developing roller 18 by a blade-like collecting member (collecting blade) provided in contact with the developing roller 18.

An intermediary transfer roller 20 as an intermediary transfer member is provided opposed to the photosensitive drum 13. Further, a transfer roller 21 as a transfer member is provided opposed to the intermediary transfer roller 20. The toner image formed on the photosensitive drum 13 is transferred onto the intermediary transfer roller 20, at a nip (contact portion) between the photosensitive drum 13 and the intermediary transfer roller 20, using the electric field, and then is fed to a nip formed between the intermediary transfer roller 20 and the transfer roller 21. Incidentally, at least one of the intermediary transfer roller 20 and the transfer roller 21 may also be an endless belt.

The recording material S accommodated in each of the cassettes 11*a*, 11*b* is fed to a registration feeding portion 23 by an associated feeding portion 22*a* or 22*b* constituted by feeding rollers. The registration feeding portion 23 feeds the recording material S to the nip between the intermediary transfer roller 20 and the transfer roller 21 by being timed to the toner image transferred on the intermediary transfer roller 20. The toner image transferred on the intermediary transfer roller 20 is transferred onto the recording material S at the nip between the intermediary transfer roller 20 and the transfer roller 21 by using an electric field. The recording material S on which the toner image is transferred is fed to a fixing device 25 as a fixing means by a feeding belt 24, and thereafter, is discharged to an outside of an apparatus main assembly 110 of the image forming apparatus 100. In this embodiment, as described later, the liquid developer D of an ultraviolet (UV)-curable type is used, the fixing device 25 irradiates the recording material S carrying the toner T and the carrier C with UV rays, and thus the carrier C is cured, so that the image is fixed on the recording material S.

On the other hand, the toner T and the carrier C which remain on the photosensitive drum 13 after the transfer are removed and collected from the photosensitive drum 13 by the drum cleaner 19. Further, the toner T and the carrier C which remain on the intermediary transfer roller 20 after the transfer are removed and collected from the intermediary transfer roller 20 by the intermediary transfer roller cleaner 26 as an intermediary transfer member cleaning means. Further, the toner T and the carrier C which are deposited on the transfer roller 21 are removed and collected from the transfer roller 21 by a transfer roller cleaner 27 as a transfer member cleaning means. Each of the cleaners 19, 26 and 27 scrapes off the toner T and the carrier C from the surface of a rotating object-to-be-cleaned by the blade-like collecting member (collecting blade disposed in carrier with the object-to-be-cleaned, and then accommodates the toner T and the carrier C in a collecting container.

2. Liquid Developer

Next, the liquid developer D will be described. In this embodiment, an ultraviolet (UV)-curable liquid developer D was used.

The liquid developer D in this embodiment is an ultraviolet (UV)-curable liquid developer which contains a cation-polymerizable liquid monomer, a photo-polymerization initiator and toner particles insoluble in the cation-polymerizable liquid monomer. In this embodiment, the cation-polymerizable liquid monomer is vinyl ether compound, and the photo-polymerization initiator is a compound represented by the following formula (1).

formula (1)

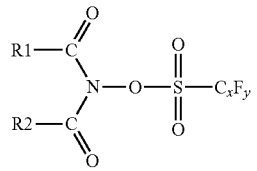

Specifically, first, the toner particles include a colorant and a toner resin material in which the colorant is incorporated. Together with the toner resin material and the colorant, the toner particles may also contain another material such as a charge control agent. As a manufacturing method of the toner particles, a well-known technique such as a coacervation in which the colorant is dispersed and a resin material is gradually polymerized so that the colorant is incorporated in the polymer or an internal pulverization method in which a resin material or the like is melted and the colorant is incorporated in the melted resin material can be used. As the toner resin material, epoxy resin, styrene-acrylic resin or the like is used. The colorant may be a general-purpose organic or inorganic colorant. In the manufacturing method, in order to enhance a toner dispersing property, a dispersant is used but a synergist can also be used.

The UV curing agent (monomer) of the developer is a mixture of about 10% (weight %) of a monofunctional monomer having one vinyl ether group (formula 2 below) and about 90% (weight %) of difunctional monomer having two vinyl ether groups (formula 3 below).

formula 2

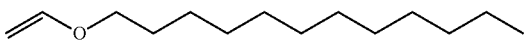

formula 3

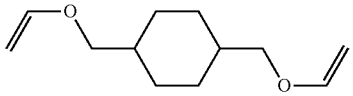

As the photo-polymerization initiator, 0.1% of a compound represented by formula 4 below was mixed. By using this photo-polymerization initiator, different from the case where an ionic photo-acid generator, a high-resistance liquid developer is obtained while enabling satisfactory fixing.

formula 4

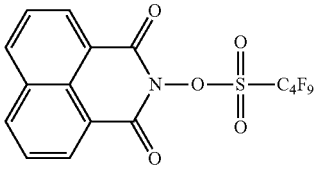

Incidentally, a cationic polymerizable liquid monomer may desirably be a compound selected from the group consisting of dichloropendadiene vinyl ether, cyclohexanedimethanol divinyl ether, tricyclodecane vinyl ether, trimethylolpropane trivinyl ether, 2-ethyl-1,3-hexamediol divinyl ether, 2,4-diethyl-1,5-pentanediol divinyl ether, 2-butyl-2-ethyl-1,3-propanediol divinyl ether, neopentylglycol divinyl ether, pentaerythritol tetravinyl ether, and 1,2-decanediol divinyl ether.

As the charge control agent, a well-known compound can be used. As a specific example, it is possible to use fats and oils such as linseed oil and soybean oil; alkyd resin; halogen polymer; oxidative condensates such as aromatic polycarboxylic acid, acidic group-containing water-soluble dye and aromatic polyamine; metallic soaps such as cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, and cobalt 2-ethylhexylate; sulfonic acid metal salts such as petroleum acid metal salt and metal salt of sulfosuccinic acid; phospholipid such as lectithin; salicylic acid metal salt such as t-butylsalicylic acid metal complex; polyvinyl pyrrolidone resin; polyamide resin; sulfonic acid-containing resin; and hydroxybenzoic acid derivative.

3. Feeding of Liquid Developer

Figure 2:
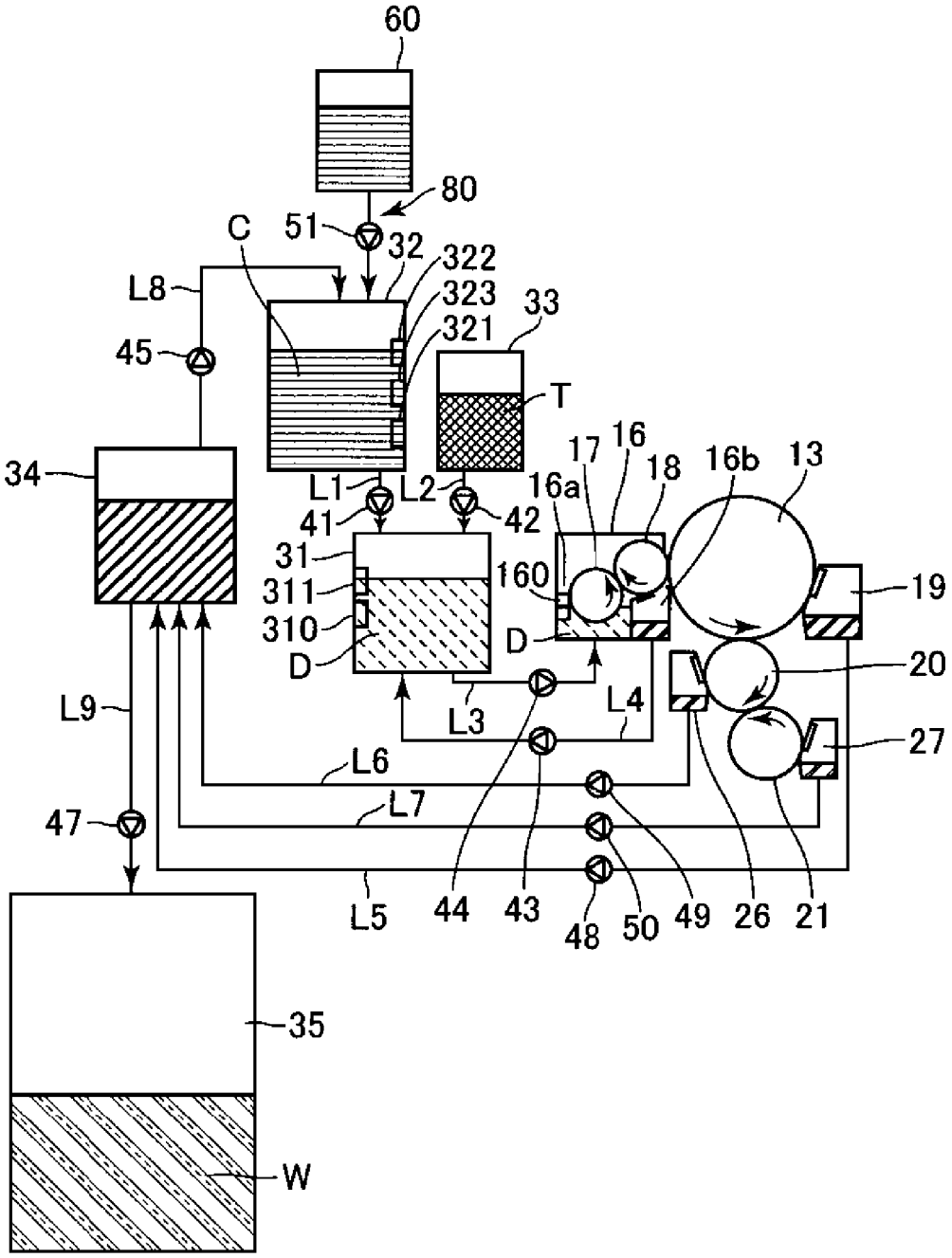
FIG. 2 is a schematic view showing a feeding path of a liquid developer.
Figure 6:
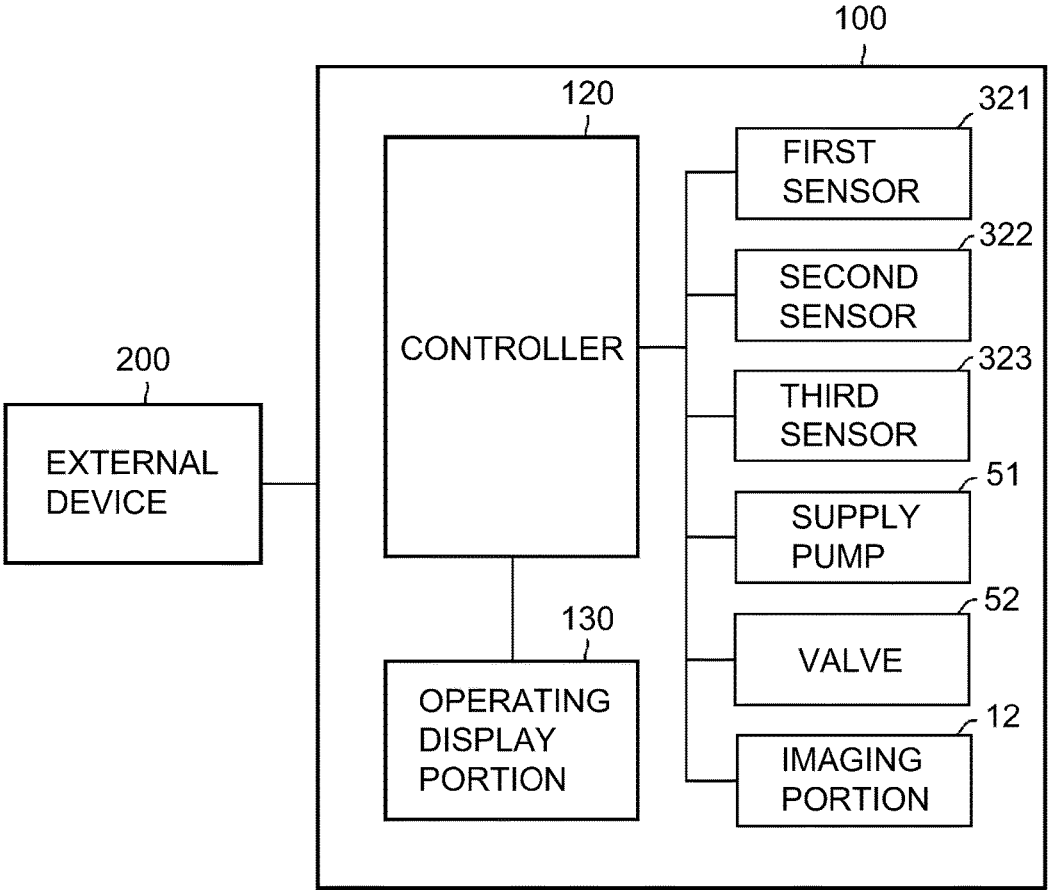
FIG. 6 is a schematic block diagram showing a control mode of a principal part of the image forming apparatus.

Next, feeding of the liquid developer D in this embodiment will be described. FIG. 2 is a schematic view showing a feeding path of the liquid developer D in the image forming apparatus 100 of this embodiment. FIG. 6 is a block diagram showing a control mode of a principal part of the image forming apparatus 100. In this embodiment, a controller 120 provided in the apparatus main assembly 110 effects integrated control of operations of the respective portions of the image forming apparatus 100. The controller 120 includes a CPU as a calculation control means and a ROM and a RAM as storing means, and carried out control of the respective portions of the image forming apparatus 100.

A transport pipe L1 connecting the carrier tank 32 and the mixer 31 is provided with a carrier supplying pump 41. A transport pipe L2 connecting the toner tank 33 and the mixer 31 is provided with a toner supplying pump 42. The controller 120 controls operations of the carrier supplying pump 41 and the toner supplying pump 42 and thus adjusts a supply amount of the toner liquid T. The mixer 31 is provided with a mixer liquid level sensor 311 for detecting the amount of the liquid developer D stored in the mixer 31 and a content sensor 310 for developing a toner content of the liquid developer D stored in the mixer 31. As t content sensor 310, a content sensor of an arbitrary type in which the toner content of the liquid developer D is detectable can be used. The controller 120 effects control of the operations of the carrier supplying pump 41 and the toner supplying pump 42 so that the toner content and a liquid amount of the liquid developer D stored in the mixer 31 reach target values.

A transport pipe L3 connecting the mixer 31 and the supply section 16*a* of the developing device 16 is provided with a developer supplying pump 44. The controller 120 causes the developer supplying pump 44 to feed the liquid developer D from the mixer 31 into the developing device 16. The supply section 16*a* of the developing device 16 is provided with a developing device liquid level sensor 160 for detecting the amount of the liquid developer D in the supply section 16*a*. The controller 120 controls an operation of the developer supplying pump 44 so that the amount of the liquid developer D detected by the developing device liquid level sensor 160 is a predetermined amount (e.g., 200 ml) or more.

The liquid developer D collected into a collecting section 16*b* of the developing device 16 is returned into the mixer 31 through a transport pipe L4 by a returning pump 43 and is used again. The liquid developer D collected in the collecting section 16*b* may also be fed into a separation and extraction device 34 described later.

The carrier C and the toner T collected by the drum cleaner 19 are fed to the separation and extraction device 34 through a transport pipe L5 by a first collecting pump 48. The carrier C and the toner T collected by the intermediary transfer roller cleaner 26 are fed to the separation and extraction device 34 through a transport pipe L6 by a second collecting pump 49. The carrier C and the toner T collected by the transfer roller cleaner 27 are fed to the separation and extraction device 34 through a transport pipe L7 by a third collecting pump 50.

The separation and extraction device 34 separates the toner T and the carrier C in order to use the carrier C again. When the separation and extraction device 34 separates the toner T and the carrier C, the separation and extraction device 34 separates a re-usable carrier C and a waste liquid W containing the toner T and an impurity such as paper powder. The separated re-usable carrier C is fed into the carrier container 32 through a transport pipe L8 by a fourth collecting pump 45. The waste liquid W is appropriately fed into a waste liquid collecting container 35 through a transport pipe L9 by a waste liquid pump 47.

A collecting means for collecting the carrier C, of the liquid developer D used for development, which is not completely transferred onto the recording material S and for returning the carrier C into the carrier container 32 is constituted by the above-described cleaners 19, 26 and 27, pumps 48, 49, 50 and 45, transport pipes L5 to L8, and separation and extraction device 34.

In the carrier container 32, each of first, second and third liquid level sensors 321, 322 and 323 as a detecting means for detecting the amount of the carrier stored in the carrier container 32 is provided. The first liquid level sensor 321 detects a lower limit of the amount of the carrier C in the carrier container 32. The second liquid level sensor 322 detects an upper limit of the amount of the carrier C in the carrier container 32. The carrier container 32 is constituted so that the carrier C does not overflow the carrier container 32 even when the amount of the carrier C reaches the upper limit and so that the carrier C is prevented from being unsuppliable to the mixer 31 even when the amount of the carrier C reaches the lower limit. The third liquid level sensor 323 detects an amount between the amounts of the carrier C detected by the first and second liquid level sensors 321 and 322. The second and third liquid level sensors 322 and 323 are used during collection of an excessive carrier in the carrier container 32 described specifically later. In this embodiment, each of the liquid level sensors 321, 322 and 323 detects a position (liquid level) of a float floated on a liquid surface, and thus detects the liquid amount of the carrier C in the carrier container 32. As the liquid level sensor, for example, a liquid level sensor in which a float provided with a magnet and a reed switch are provided and a position of the float is detected by the reed switch is used. However, the liquid amount detecting means is not limited to such a flat sensor, but any known available means can also be used. This is true for also the above-described liquid level sensor 311 and the developing device liquid level sensor 160.

When the first liquid level sensor 321 detects that the amount of the carrier C decreases to a predetermined lower limit (e.g., 4500 ml), the controller 120 discriminates that there is a need to supply the carrier C, and the carrier C is supplied into the carrier container 32. In this embodiment, a supply bottle 60 which is a supply container in which a fresh carrier is accommodated is detachably mountable to the apparatus main assembly 110. That is, in this embodiment, in the apparatus main assembly 110, a supplying portion 80 for receiving the carrier C to be supplied into the carrier container 32 is provided. In this embodiment, the supplying portion 80 is constituted by a pipe path communicated with the carrier container 32. The supply bottle 60 is provided with a supply opening portion 61 (FIG. 5) as a mounting portion provided to one end portion thereof, and is connected with the carrier container 32 by removably connecting the supply opening portion 61 with a supply bottle connecting portion 81 provided at one end portions of the supplying portion 80. In this embodiment, the supplying portion 80 is provided with a supplying carrier supplying pump 51. The controller 120 causes the supplying carrier supplying pump 51 to supply the carrier C from the supply bottle 60 into the carrier container 32. In this embodiment, the controller 120 controls an operation of the supplying carrier supplying pump 51 so that the amount of the carrier C detected by the first liquid level sensor 321 is not less than a predetermined lower limit.

Typically, the supplying 60 is exchanged with a fresh (new) supply bottle in the case where the supply bottle 60 is used up (empty state). The empty state of the supply bottle 60 can be detected by no change in detection signal of the first liquid level sensor 321 irrespective of a supplying operation of the carrier C from the supply bottle 60. Separately, a means for detecting the amount of the carrier C may also be provided.

4. Consumption of Liquid Developer

Consumption of the liquid developer D in the image forming apparatus 100 in this embodiment will be described.

In this embodiment, in transfer steps from the coating roller 17 to the recording material S, of the liquid developer D and the toner image, electric fields are used. To each of the nips where the respective transfer steps are carried out, a voltage is applied by a voltage applying device (not shown) so that the electric field for moving the toner T from an original position to a destination of the transfer is generated. For example, to the nip between the photosensitive drum 13 and the intermediary transfer roller 20, the voltage is applied so that an electric field such that the toner T is attracted to the intermediary transfer roller 20 is generated. As a result, during passing of the liquid developer D through the nips where the respective transfer steps are performed, the toner T is principally carried on transfer destination members, while the carrier C after being separated from the toner T is principally carried on transfer original members. Accordingly, with repetition of the transfer steps, the toner content of the liquid developer D to be transferred increases.

In this embodiment, the toner content of the liquid developer D fed from the mixer 31 into the developing device 16 is 5-10%. On the other hand, the toner content of the toner image (liquid developer D) transferred on the recording material S is 80-90% in the case where an image ratio is highest. Further, the toner content of the toner liquid T accommodated in the toner container 33 is 40-50%.

A ratio of a consumption between the toner T and the carrier C by image formation (in this case, this ratio is represented by a toner consumption ratio which is a proportion of the weight of the toner T to the weight of the consumed liquid developer D) varies depending on an image ratio of the image to be formed. For example, in the case where the image ratio is 0%, i.e., no toner image is formed at all, the electrostatic latent image is not formed on the photosensitive drum 13, and therefore, the toner T is not transferred from the developing device 16 onto the photosensitive drum 13, so that the toner consumption ratio is 0%. However, a non-chargeable carrier C is partly carried on the photosensitive drum 13 depending on its viscosity. Also in a subsequent transfer step, a part of the carrier C is similarly transferred depending on the viscosity of the carrier C, and therefore, a thin film of the carrier C is formed on the recording material S in an entire region. In this case, only the operation C is consumed by the image formation. Similar consumption of the carrier C is also observed in, e.g., a local marginal region in the case where a character image is printed.

On the other hand, for example, in the case where the image ratio is 100%, the toner image is formed on the recording material S in a substantially entire region, so that a thin film of the carrier C is formed on the surface of the recording material S. The toner consumption ratio by the image formation in this case is about 80-90% as described above.

When the toner consumption ratio by the image formation exceeds the toner content of the toner liquid stored in the toner consumption 33, the amount of the carrier C which is contained in the toner liquid T and which is supplied to the developing device 16 exceeds the amount of the consumed carrier C. Specifically, the case where an average image ratio of the image formed on the recording material S in the image forming apparatus 100 of this embodiment is 20-30% will be considered. In this case, the amount of the carrier C used again through the separation and extraction device 34 dilutes the toner liquid T (toner content: 40-50%) supplied to the mixer 31, and is sufficient as an amount necessary to change the toner content to a desired toner content (5-10%) of the liquid developer D fed to the developing device 16. For that reason, there is no need to supply the carrier C from the supply bottle 60 into the carrier container 32. On the other hand, when the average image ratio of the image formed on the recording material S exceeds 20-30%, the carrier C which is not consumed accumulates, so that the amount of the carrier C stored in the carrier container 32 increases.

Figure 3:
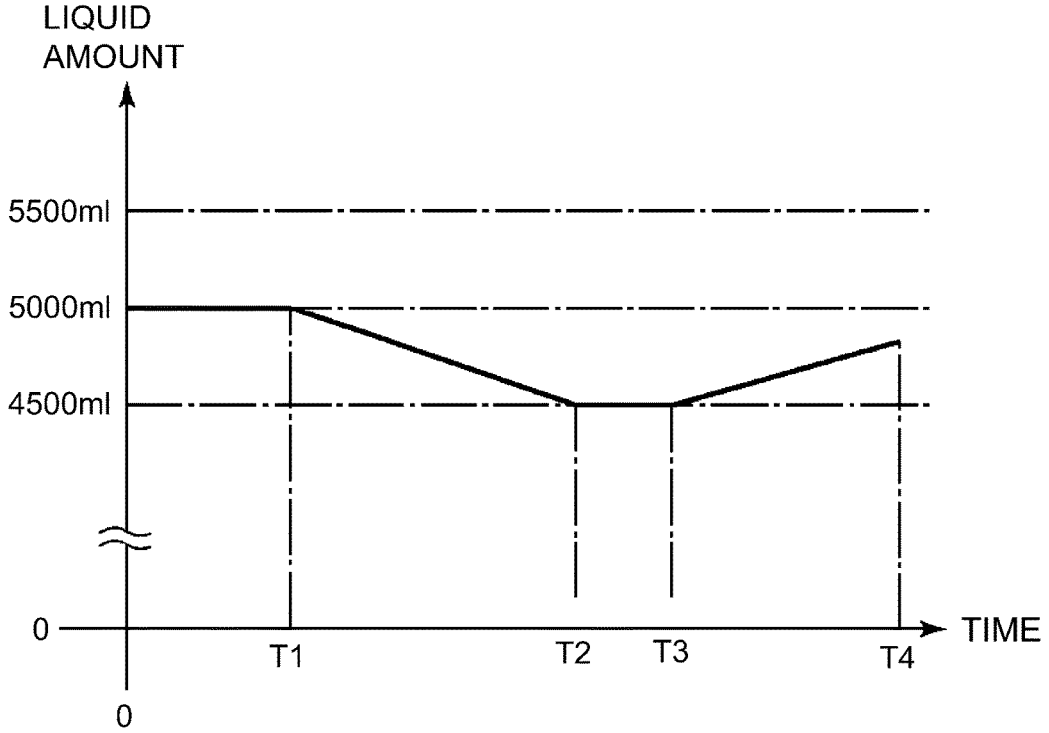
In FIG. 3, (a) is a graph showing a relationship between a liquid amount in a carrier tank and a time, and (b) is a graph showing a relationship between an image ratio and a time.
Figure 3:
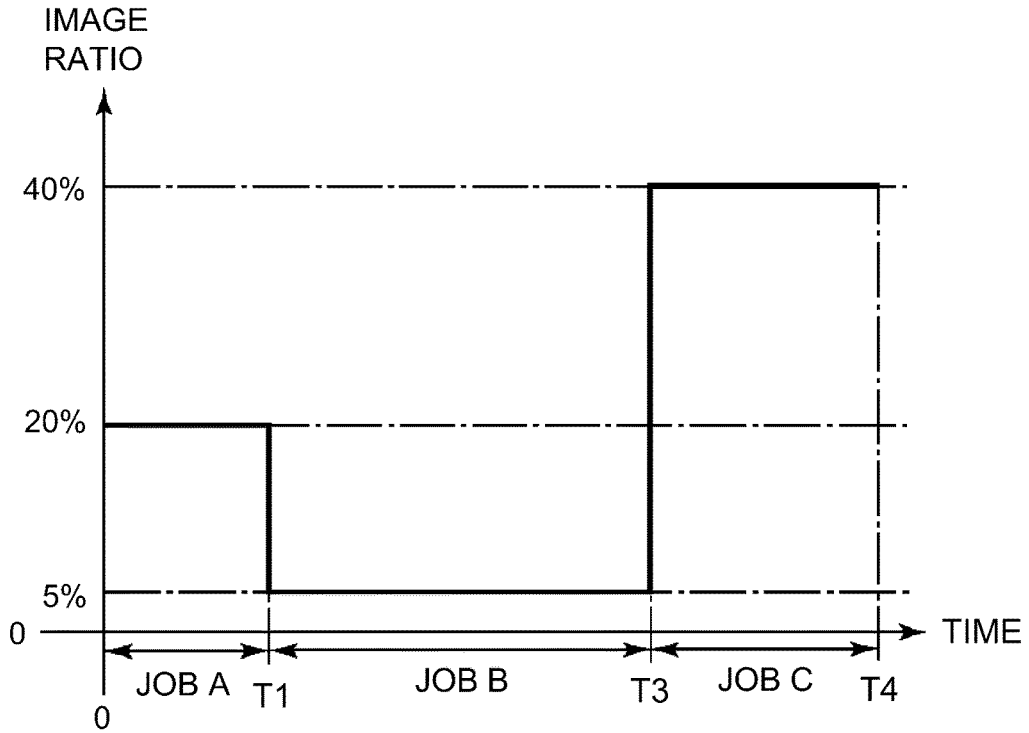

In FIG. 3, (a) and (b) show examples showing a relationship between an elapsed time and an amount (volume) of the carrier C stored in the carrier container 32 and a relationship between an elapsed time and an average image ratio of the image formed on the recording material S, respectively. As an example, the case where jobs (a series of operations for forming an image on a single or a plurality of recording materials) A, B and C in which the average image ratios are 20%, 5% and 40%, respectively, will be considered. An image with the average image ratio of 5% corresponds to an office document such that e.g., only a character is printed, and an image with the average image ratio of 40% corresponds to a magazine page space or a catalogue on which, e.g., photographic or illustration image is frequently used.

During a period (time 0 to T1) in which the job A (average image ratio: 20%) is carried out, the toner consumption ratio by the image formation is substantially equal to the toner content of the toner liquid T stored in the toner container 33. For that reason, the carrier C contained in the toner liquid T and the carrier C used again through the separation and extraction device 34 are sufficient to prepare the liquid developer D fed to the developing device 16. Accordingly, even when the fresh (new) carrier C is not supplied from the supply bottle 60, the amount of the carrier C stored in the carrier container 32 is maintained at an initial value of 5000 ml. Here, the toner T and the carrier C consumed by the image formation are a sum of those transferred onto the recording material S and those discharged as the waste liquid W.

During a period (time T1 to T3) in which the job B (average image ratio: 5%) is carried out, the toner consumption ratio by the image formation is smaller than the toner content of the toner liquid T stored in the toner container 33. For that reason, in addition to the carrier C contained in the toner liquid T and the carrier C used again through the separation and extraction device 34, the carrier C stored in the carrier container 32 is consumed for preparing the liquid developer D fed to the developing device 16. Accordingly, the amount of the carrier C stored in the carrier container 32 decreases. At a time T2, the amount of the carrier C stored in the carrier container 323 reaches the lower limit (4500 ml). For that reason, the fresh carrier C is supplied from the supply bottle 60 into the carrier container 32, so that the amount of the carrier C stored in the carrier container 32 is maintained at the lower limit.

During a period (time T3 to T4) in which the job C (average image ratio: 40%) is carried out, the toner consumption ratio by the image formation is higher than the toner content of the toner liquid T stored in the toner container 33. For that reason, the amount of the carrier C contained in the toner liquid T and supplied and used again through the separation and extraction device 34 exceeds the amount of the consumed carrier C, so that the amount of the carrier C stored in the carrier container 32 increases.

Figure 4:
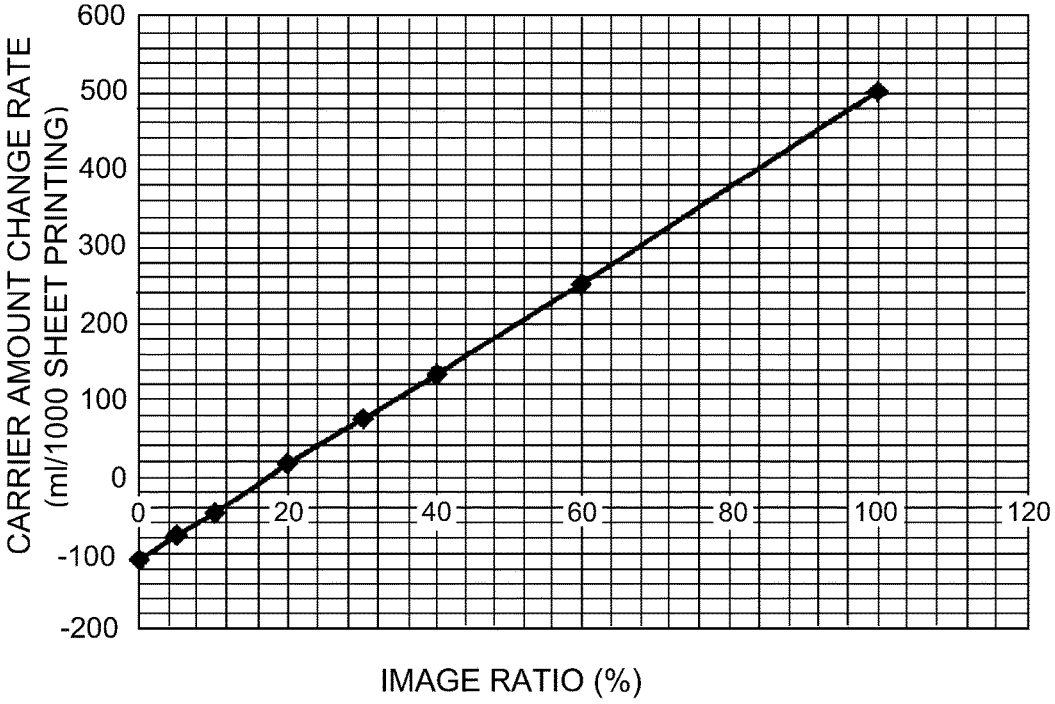
FIG. 4 is a graph showing a relationship between the image ratio and a carrier amount change rate.

FIG. 4 shows an example of a relationship between the image ratio of the image formed on the recording material S and a changing (increasing and decreasing) rate of the amount of the carrier C stored in the carrier container 32. As is understood from FIG. 4, an increase and a decrease of the amount of the carrier C stored in the carrier container is largely influenced by the image ratio of the formed image. When the job with a high image ratio is continued, the amount of the carrier C stored in the carrier container 32 continuously increases and finally overflows the carrier container 32. A time reaching the overflow varies depending on the image ratio of the formed image, but when the image formation is continued in a mode in which the amount of the carrier C stored in the carrier container 32, the carrier C overflows the carrier container 32 sooner or later.

As described above, in the constitution of JP-A Hei 9-244419, the excessive carrier in the carrier container is evaluated to the excessive liquid container, but in the case where the job with the high image ratio is continued, the carrier container and the excessive container are filled with the carrier sooner or later, so that there is a possibility of overflow.

For that reason, there is a need to perform maintenance such that the carrier container is exchanged by the service person for the image forming apparatus, so that there is a possibility that a service cost increases.

5. Collection of Excessive Carrier

Figure 5:
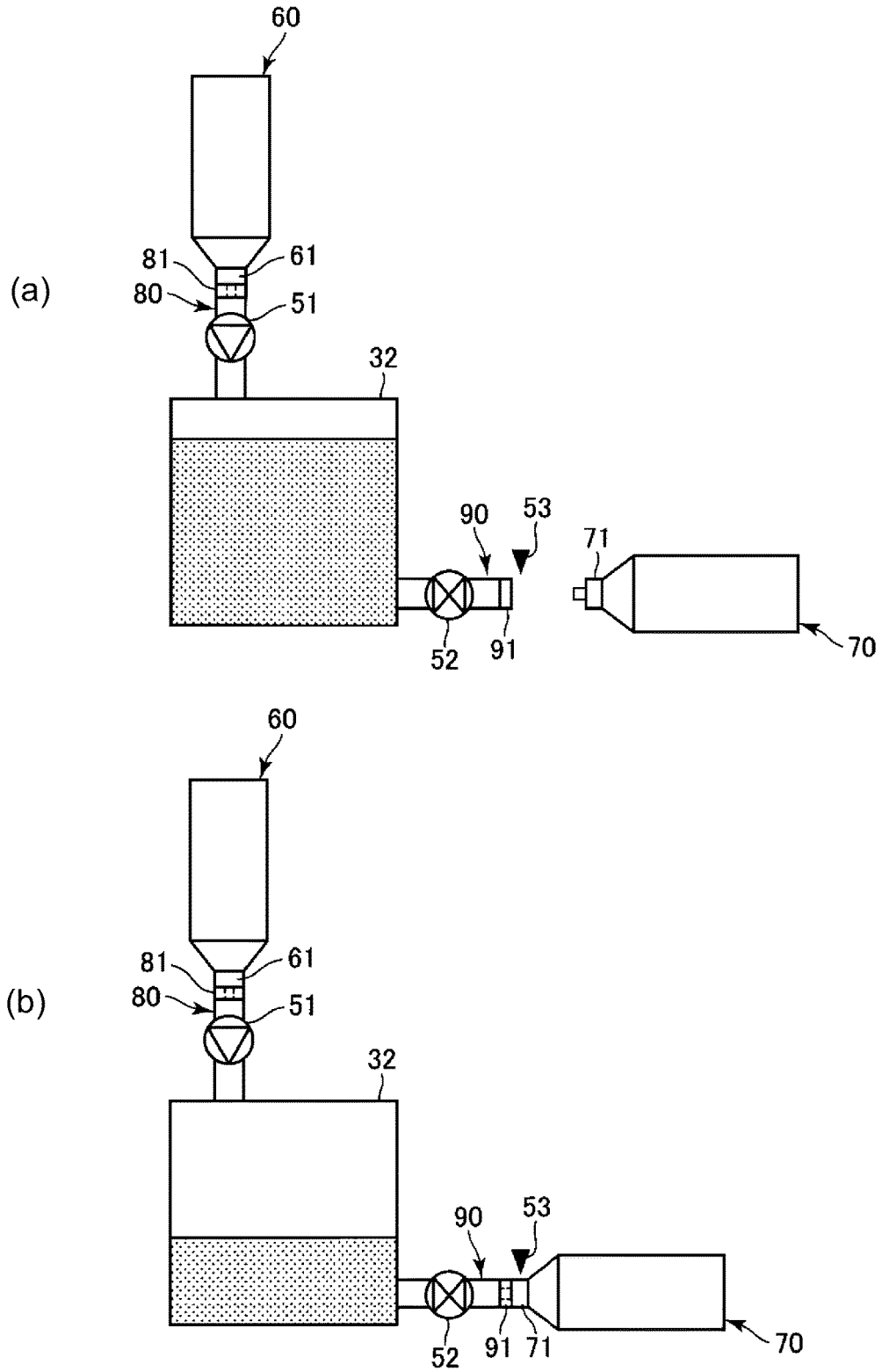
In FIG. 5, (a) and (b) are schematic views for illustrating a system for collecting an excessive carrier.

Collection of the excessive carrier in this embodiment will be described. In FIG. 5, (a) and (b) are schematic views, of the carrier container 32 and its periphery, for illustrating an excessive carrier collecting system in this embodiment.

In this embodiment, a collecting bottle 70 which is a collecting container for collecting the excessive carrier in the carrier container 32 is detachably mountable to the apparatus main assembly 110. That is, in this embodiment, in the apparatus main assembly 110, a discharging portion 90 for permitting discharge of the carrier C stored in the carrier container 32 is provided. In this embodiment, the discharging portion 90 is constituted by a pipe path communicated with the carrier container 32. The collecting bottle 70 is connected with the carrier container 32 by connection of a collecting operation portion 71 as a mounting portion provided at one end portion thereof with a collecting bottle connecting portion 91 provided at one end portion of the discharging portion 90 in a detachably mountable manner.

An engaging portion between the collecting bottle connecting portion 91 and the collecting operation portion 71 has a structure such that the carrier C is prevented from leaking to an outside when the carrier C is moved from the carrier container 32 into the collecting bottle 70. In this embodiment, at an inner periphery of the collecting bottle connecting portion 91, a rubber packing (gasket) as a sealing means for engaging with an outer periphery of the collecting operation portion 71 in a fluid-tight manner. As the sealing means, any available means can be used, but it is desirable that a material having a sufficient resistance to a component of the carrier C. Further, the collecting operation portion 71 of the collecting bottle 70 has a structure such that the carrier C is prevented from leaking out of the collecting bottle 70 when the collecting bottle 70 is mounted to and demounted from the collecting bottle connecting portion 91 of the discharging portion 90. In this embodiment, the collecting operation portion 71 is provided with a valve so as to be opened when the collecting bottle 70 is mounted to the collecting bottle connecting portion 91 and so as to be closed when the collecting bottle 70 is demounted from the collecting bottle connecting portion 91. As the valve, a valve having any available structure can be used. As materials of constituent parts of the collecting bottle (collecting container) 70 such as the portion (main body) for accommodating the carrier C, the above-described valve, and the like, it is desirable that materials through which ultraviolet (UV) rays do not pass are selected. As a result, the UV-curable carrier C can be prevented from being cured with the UV rays during the collection of the carrier C, during storing and supply of the carrier C in the case where the collected carrier C is used again as described above. Further, as regards a volume of the collecting bottle 70, it is desirable that the volume is to the extent that the weight of the collecting bottle 70 is a weight such that the collecting bottle 70 is portable by the operator in a state in which the collecting bottle 70 is filled with the carrier C (in a full state). For example, the volume of the collecting bottle 70 may suitably be about 500-1000 ml.

In this embodiment, the discharging portion 90 is provided with an electromagnetic valve 52 as a liquid level control means. As specifically described later, the controller 120 controls operation and closing of the electromagnetic valve 52, so that the carrier C is moved from the carrier container 32 into the collecting bottle 70 connected with the discharging portion 90.

In this embodiment, the apparatus main assembly 110 is provided with a bottle sensor 53 as a collecting container detecting means for detecting connection of the collecting bottle 70 with the discharging portion 90 and disconnection of the collecting bottle 70 from the discharging portion 90. The bottle sensor 53 may be, for example, a bottle sensor for detecting the presence or absence of the collecting bottle 70 at a mounting portion of the apparatus main assembly 110 where the collecting bottle 70 is detachably mountable to the discharging portion 90 and for detecting operation and closing of an openable door, of the apparatus main assembly 110, for permitting mounting and demounting of the collecting bottle 70.

Figure 7:
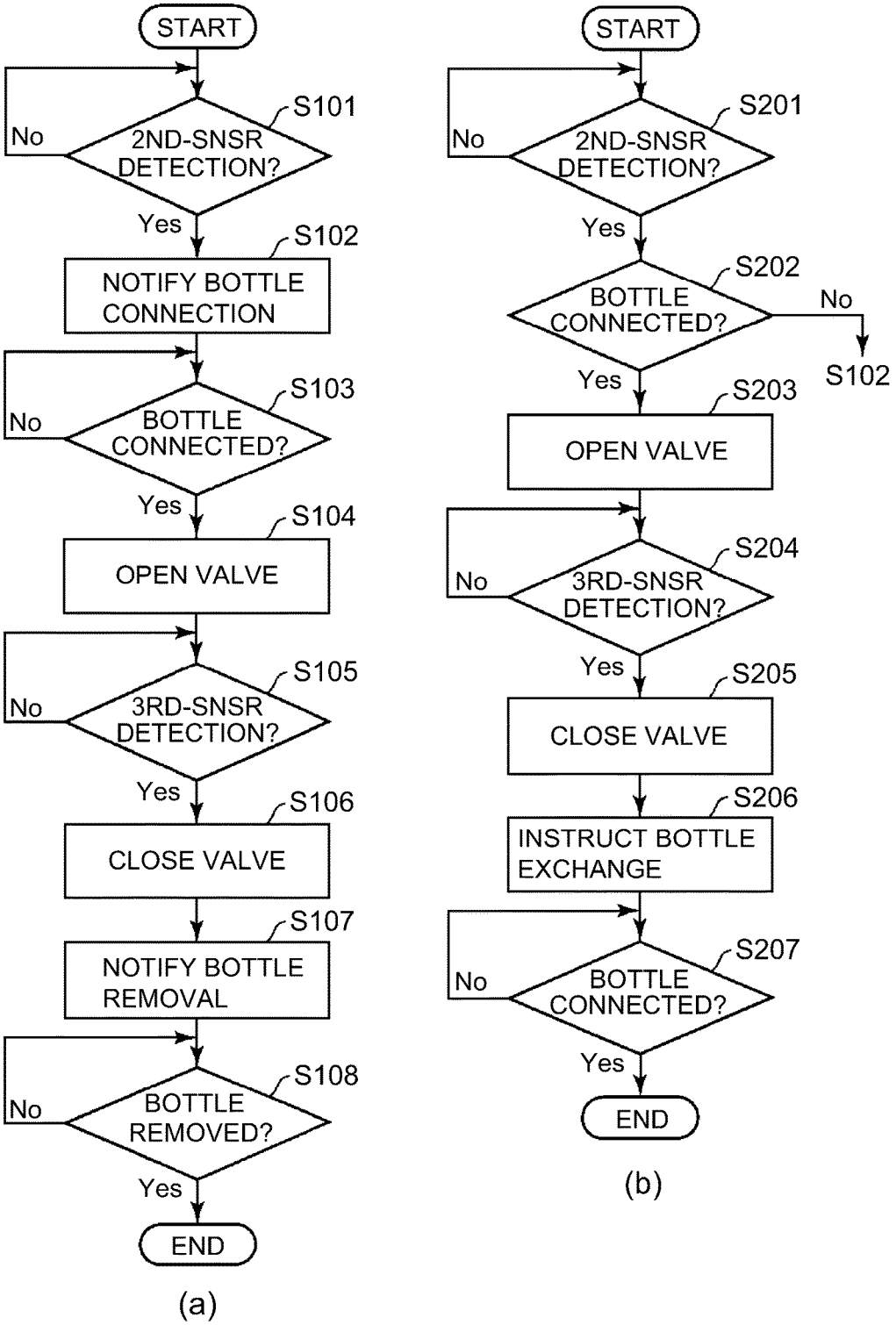
In FIG. 7, (a) and (b) are flowcharts each showing a collecting procedure of the excessive carrier.

A collecting procedure of the excessive carrier in this embodiment will be further described with reference to FIGS. 6 and 7. In FIG. 7, (a) is a flowchart showing a procedure in the case where the collecting bottle 70 is connected with the discharging portion 90 when the excessive carrier C in the carrier container 32 is detected. In FIG. 7, (b) is a flowchart showing a procedure in the case where the collecting bottle 70 is connected with the discharging portion 90 before the carrier C in the carrier container 32 becomes excessive.

First, the procedure shown in (a) of FIG. 7 will be described. In this case, during operation of the image forming apparatus 100, as shown in (a) of FIG. 5, the collecting bottle 70 is not connected with the discharging portion 90. When the second liquid level sensor 322 detects that the amount of the carrier C in the carrier container 32 reaches a predetermined upper limit (e.g., 5500 ml), the controller 120 discriminates that the carrier C becomes excessive (S101). Then, the controller 120 causes an operation display portion 130 provided on the apparatus main assembly 110 to display a message (notification) prompting the operator such as the user to collect the excessive carrier in the carrier container 32 by connecting the collecting bottle 70 with the discharging portion 90 (S102). The operation display portion 130 has a function as a display means (display portion) for displaying information and a function of an increase means (operating portion) through which various instructions are inputted to the controller 120. When the job is under execution, the controller 120 interrupts the job.

In accordance with the display of the operation display portion 130, the operator connects the collecting bottle 70 prepared in advance, with the discharging portion 90 ((b) of FIG. 5). When the connection of the collecting bottle 70 is detected by the bottle sensor 53 (S103), the controller 120 causes the electromagnetic valve 52 to open (S104). As a result, the carrier C in the carrier container 32 flows into the collecting bottle 70 through the discharging portion 90. Thereafter, when the third liquid level sensor 323 detects that the amount of the carrier C in the carrier container 32 decreases to a predetermined value, the controller 120 discriminates that the collecting bottle 70 is filled with the operation C (S105), the controller 120 causes the electromagnetic valve 52 to close (S106). Then, the controller 120 causes the operation display portion 130 to display a message (notification) prompting the operator to demount the collecting bottle 70 from the discharging portion 90 (S107).

In accordance with the display of the operation display portion 130, the operator demounts the collecting bottle 70 from the discharging portion 90 ((a) of FIG. 5). Thereafter, the controller 120 checks the demounting of the collecting bottle 70 by the bottle sensor 53 (S108) and ends the process. The controller 120 resumes the job when the job is interrupted at this time.

Next, the procedure shown in (b) of FIG. 7 will be described. In this case, also during operation of the image forming apparatus 100, as shown in (b) of FIG. 5, the collecting bottle 70 is connected with the discharging portion 90. When the second liquid level sensor 322 detects that the amount of the carrier C in the carrier container 32 reaches a predetermined upper limit (e.g., 5500 ml) (S201), the controller 120 checks the connection of the collecting bottle 70 by the bottle sensor 53 (S202). In the case where the collecting bottle 70 is not connected, the controller 120 causes the associated portions to execute the processes steps of 5102 and the later. On the other hand, in the case where the collecting bottle 70 is connected, the controller 120 causes the electromagnetic valve 52 to open (S203). As a result, the carrier C in the carrier container 32 flows into the collecting bottle 70 through the discharging portion 90. Thereafter, when the third liquid level sensor 323 detects that the amount of the carrier C in the carrier container 32 decreases to a predetermined value (S204), the controller 120 causes the electromagnetic valve 52 to close (S205). Then, the controller 120 causes the operation display portion 130 to display a message (notification) prompting the operator to demount the collecting bottle 70 from the discharging portion 90 and then to mount an empty collecting bottle 70 (S206).

In accordance with the display of the operation display portion 130, the operator demounts the collecting bottle 70 from the discharging portion 90 ((a) of FIG. 5) and then connects the empty collecting bottle 70 with the discharging portion 90 ((b) of FIG. 5). Thereafter, the controller 120 checks the connection of the collecting bottle 70 by the bottle sensor 53 (S207) and ends the process.

The case where the carrier in the carrier container 32 becomes excessive is the case where the job is continuously executed by an operation in a specific mode as described above, and therefore, as shown in (a) of FIG. 7, in many cases, the collecting bottle 70 is enough to be connected with the discharging portion 90 only as needed. However, as shown in (b) of FIG. 7, the collecting bottle 70 is connected with the discharging portion 90 in advance, so that it is possible to prevent failure in preparation of the collecting bottle 70 when the collecting bottle 70 is needed. Further, it becomes possible to collect the excessive carrier without interrupting the job.

Thus, according to this embodiment, the excessive carrier is collected in the collecting bottle 70 detachably mountable to the apparatus main assembly 110, so that it is possible to prevent overflow of the carrier container 32 with the carrier.

In place of or in addition to the above-described notification at the operation display portion 130, the notification may also be carried out at a display portion of an external device 200 such as a personal computer communicatably connected with the apparatus main assembly 110.

In this embodiment, the discharging portion 90 is provided with the electromagnetic valve 52 and the third liquid level sensor 323 is provided inside the carrier container 32, and the feeding of the carrier C from the carrier container 32 to the collecting bottle 70 was controlled, but the present invention is not limited thereto. For example, the feeding of the carrier C from the carrier container 32 to the collecting bottle 70 may also be controlled in a manner such that the operator connects the collecting bottle 70 with the discharging portion 90 and operates a manual valve provided to the discharging portion 90. Further, a non-return (check) valve which is opened by externally inserting the collecting operation portion 71 of the collecting bottle 70 is provided to the collecting bottle connecting portion 91 of the discharging portion 90, and the non-return valve may be opened mechanically by an urging (pressing) force when the non-return valve connects the collecting bottle 70. The non-return value is caused to have a structure such that the non-return valve is sufficiently hermetically sealed during closing in order to prevent the carrier C in the carrier container 32 from leaking out of the carrier container 32 in the case where the non-return valve is closed. For example, the hermetically sealed state is ensured by applying a rubber to a periphery of the valve. As the rubber, it is desirable that a material having a sufficient resistance to a component of the carrier C.

In order to prevent the overflow of the carrier container 32 in the above-described manner, there is a need to prepare the collecting bottle 70. Therefore, in this embodiment, commonalty of shapes and structures of the supply bottle 60 and the collecting bottle 70 was achieved. That is, in this embodiment, the supply opening portion 61 of the supply bottle 60 and the collecting operation portion 71 of the collecting bottle 70 have the same shape and the same structure. Further, in this embodiment, the supply bottle connecting portion 81 of the supplying portion 80 and the collecting bottle connecting portion 91 of the discharging portion 90 have the same shape and the same structure. As a result, the supply bottle 60 which is used by supplying the carrier C to the carrier container 32 can be used as the collecting bottle 70. Further, by achieving the commonalty of the shapes and the structures of the supply bottle 60 and the collecting bottle 70, the collecting bottle 70 (which may also be the bottle used as the supply bottle 60) can also be used again as the supply bottle 60. That is, the carrier C discharged from the carrier container 32 and collected in the collecting bottle 70 (which may also be the bottle used as the supply bottle 60) can be supplied again as the carrier C for supply to the carrier container 32. As a result, the carrier collected from the carrier container 32 is not disposed of, and therefore, also a lowering in running cost of the image forming apparatus 100 can be realized.

Thus, in this embodiment, with the discharging portion 90, the collecting bottle 70 accommodating the carrier C discharged from the carrier container 32 and detachably mountable to the apparatus main assembly 110 is connectable. Further, in this embodiment, with the supplying portion 80, the supply bottle 60 accommodating the carrier C supplied to the carrier container 32 and detachably mountable to the apparatus main assembly 110 is connectable. Further, in this embodiment, with the discharging portion 90, the supply bottle 60 after supplying the carrier C to the carrier container 32 is connectable as the collecting bottle 70. Further, with the supplying portion 80, the collecting bottle 70 accommodating the carrier C discharged from the carrier container 32 is connectable as the supply bottle 60.

In other words, in this embodiment, the following control method of the amount of the carrier C in the carrier storing container is provided. That is, the control method is constituted by including a part or all of four steps including a step of demounting the container 60 (70), accommodated the carrier C supplied to the carrier container 32 and detachably mountable to the apparatus main assembly 110, from the supplying portion 80 provided in the apparatus main assembly for the purpose of receiving the carrier C supplied to the carrier container 32, a step of connecting the container 60 (70), demounted from the supplying portion 80, with the discharging portion 90 provided in the apparatus main assembly for the purpose of discharging the carrier C stored in the carrier container 32, a step of discharging the carrier C stored in the carrier container 32 from the discharging portion 90 and of accommodating the carrier C in the container 60 (70) connected with the discharging portion 90, and a step of demounting the container 60 (70) accommodating the carrier C discharged from the carrier container 32. The control method may further include a step of connecting the container 60 (70), demounted from the discharging portion 90, with the discharging portion 90 again. In other words, in this embodiment, the following container capable of being used for supplying and collecting the carrier C and detachably mountable to the apparatus main assembly 110 is provided. That is, this container is the container 60 (70) including the mounting portion 61 (71) connectable with both of the discharging portion 90 for permitting discharge of the carrier C from the carrier container 32 and the supplying portion 80 for permitting the supply of the carrier C to the carrier container 32.

As described above, according to this embodiment, in the case where the carrier C in the carrier container 32 becomes excessive, the user himself (herself) can collect the excessive carrier easily without causing a service provider of the image forming apparatus 100 to go to a destination (place of the user). Therefore, according to this embodiment, it is possible to prevent the excessive carrier from overflowing the carrier container 32 without increasing a service cost. Further, as the collecting bottle 70, the supply bottle 60 which is needed for a normal operation of the image forming apparatus 100 and which has been used up can be used. As a result, a degree of necessity of separate preparation of the collecting bottle 70 can be reduced, so that it is possible to prevent the user from forgetting about the preparation of the collecting bottle 70 and it is possible to reduce a space for storing the collecting bottle 70. As a result, the carrier C collected in the collecting bottle 70 can be used again as the carrier C for supply, so that a running cost of the image forming apparatus 100 can be reduced.

Other Embodiments

In the above, the present invention was described based on the specific embodiment, but is not limited to the above-described embodiment.

In the above-described embodiment, the carrier was of the UV-curable type, but the present invention does not restrict the liquid carrier. For example, the carrier may also be of a heat-curable type.

In the above-described embodiment, the case where the supply container is used as the collecting container in the constitution in which the carrier is supplied from the supply container, detachably mountable to the apparatus main assembly, to the container storing container was described as an example. According to such an embodiment, the effects as described above can be obtained, but the present invention is not limited to such an embodiment. The supplying means for supplying the carrier to the carrier storing container may be any means, and in the case where the supply container is not used as the collecting container, the collecting container may only be required to be separately prepared.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-143439 filed on Jul. 21, 2016, which is hereby incorporated by reference herein in its entirety.

What is claimed is:

1. An image forming apparatus comprising:

an image forming portion, including an image bearing member and a developing device configured to develop an electrostatic latent image, formed on said image bearing member, with a liquid developer containing toner and a liquid carrier, wherein said image forming portion is configured to form an image on a recording material;

a carrier storing container configured to store the carrier;

a mixer configured to mix the toner and the carrier to form the liquid developer to be supplied to said developing device, wherein the liquid developer has a predetermined toner ratio;

a first discharging portion provided on said carrier storing container and configured to discharge the carrier toward said mixer;

a collecting mechanism configured to collect the carrier from said image forming portion into said carrier storing container; and a second discharging portion provided on said carrier storing container and configured to discharge the carrier toward a carrier collecting container configured to collect the carrier, wherein said carrier collecting container is detachably mountable to said carrier storing container.

2. An image forming apparatus according to claim 1, wherein to said carrier storing container, a carrier supplying container in which the carrier is accommodated is detachably mountable, and wherein said image forming apparatus further comprises a supplying portion configured to supply the carrier from said carrier supplying container mounted to said carrier storing container into said carrier storing container.

3. An image forming apparatus according to claim 2, wherein said carrier supplying container is mountable as said collecting container to said second discharging portion.

4. An image forming apparatus according to claim 1, further comprising an opening and closing mechanism configured to open and close said second discharging portion.

5. An image forming apparatus according to claim 1, further comprising, a display portion configured to display information, a detecting portion configured to detect an amount of the carrier stored in said carrier storing container, and a controller configured to control said display portion so as to display a message to the effect that said collecting container should be connected with said second discharging portion when said detecting portion detects that the amount of the carrier stored in said carrier storing container reaches a predetermined value.

6. An image forming apparatus according to claim 1, further comprising, a liquid feeding portion configured to feed the carrier from said carrier storing container into said collecting container connected with said second discharging portion, a detecting portion configured to detect an amount of the carrier stored in said carrier storing container, and a controller configured to control said liquid feeding portion so as to feed the carrier from said carrier storing container into said collecting container when said detecting portion detects that the amount of the carrier stored in said carrier storing container reaches a predetermined value.

* * * * *